United States Patent [19]

Fortin et al.

[11] Patent Number: 4,614,552

[45] Date of Patent: Sep. 30, 1986

[54] ALUMINUM ALLOY SHEET PRODUCT

[75] Inventors: Paul E. Fortin; Michael J. Bull, both of Kingston, Canada

[73] Assignee: Alcan International Limited, Montreal, Canada

[21] Appl. No.: 762,566

[22] Filed: Aug. 5, 1985

Related U.S. Application Data

[63] Continuation of Ser. No. 539,611, Oct. 6, 1983, abandoned.

[51] Int. Cl.[4] ..... C22C 21/02

[52] U.S. Cl. ..... 148/417; 148/439; 420/534; 420/535

[58] Field of Search ..... 420/533, 534, 535; 148/2, 11.5 A, 12.7 A, 159, 417, 439

[56] References Cited

U.S. PATENT DOCUMENTS

| | | | |
|---|---|---|---|
| 3,306,787 | 2/1967 | Dies | 148/11.5 A |
| 3,392,062 | 7/1968 | Altenpohl et al. | 148/11.5 A |
| 3,464,866 | 9/1969 | Pryor | 148/12.7 A |
| 4,082,578 | 4/1978 | Evancho et al. | 148/12.7 A |
| 4,412,870 | 11/1983 | Vernam et al. | 148/11.5 A |
| 4,424,084 | 1/1984 | Chisholm | 148/417 |

*Primary Examiner*—L. Dewayne Rutledge
*Assistant Examiner*—Robert L. McDowell
*Attorney, Agent, or Firm*—Cooper, Dunham, Griffin & Moran

[57] ABSTRACT

Aluminum alloy sheet constituted of an alloy containing 0.65–0.79% Cu, 0.62–0.82% Mg, and 0.60–1.0% Si, produced by the successive steps of casting, homogenizing, cold rolling and solution-heat-treating, the sheet having strength and formability suitable for forming into automotive body members and being age-hardenable under paint-baking conditions.

8 Claims, 2 Drawing Figures

ALUMINUM ALLOY SHEET PRODUCT

This is a continuation of application Ser. No. 06/539,611, filed Oct. 6, 1983 now abandoned.

BACKGROUND OF THE INVENTION

This invention relates to aluminum alloy sheet products and methods of making them. In an important specific aspect, to which detailed reference will be made herein for purposes of illustration, the invention is directed to aluminum alloy sheet products having strength, formability, corrosion resistance, and age-hardening properites advantageously suitable for forming automobile body members.

It has long been conventional to fabricate automobile body members (i.e. hoods, trunk lids, doors, floor panels, and the like) of sheet steel, but increasingly in recent years, aluminum alloy sheet has been used for such members, because of the relatively light weight of aluminum as well as for other reasons. In order to be acceptable for automobile body sheet, however, an aluminum alloy must not only possess requisite characteristics of strength and corrosion resistance, but must also exhibit good formabability. Since aluminum alloy body sheet must often be formed in dies designed for mild steel, the relatively low formability of some aluminum alloys as compared to steel, particularly in respect of bendability, has limited use of aluminum alloys as a substitute for steel in automotive body members. Moreover, the hem flanging operation frequently employed to join the exterior panel member to the inner support panel member of a commercial automotive body panel requires that the metal be subjected to a 180° bend over a single sheet thickness; some of the stronger aluminum alloys are incapable of producing a crack-free hem flange, necessitating resort to a so-called rope hem flange which incorporates a larger bend.

As a further consideration bearing on suitability of aluminum alloys for automotive body use, the advent of stretch-draw forming technology on a commercial scale for large body panels has shifted the emphasis in sheet properties from avoidance of necking during drawing to promotion of uniform stretching and minimization of springback. The objective of stretch-draw techniques is to promote uniform deformation such that all the blanked sheet metal receives at least some straining and no localized regions are subjected to excessively large strains; hence, for these operations, alloy sheet should have a high work-hardening capability at relatively low strains, as well as a low springback tendency.

An increasingly important consideration in the selection of a suitable aluminum alloy for an automotive "stamping" is its versatility. For with an alloy that possesses the proper combination of strength and formability, a wide range of components may be manufactured. A case in point is that of an automotive hood, which consists of a difficult-to-form inner support panel and a strong, dent-resistant outer skin. Historically, this has required the selection of two alloys: for example, the more formable AA-6009 alloy for the inner panel, and the stronger 6010 alloy for the outer panel. This necessity of purchasing two alloys for such a component is an undesirable feature, resulting in increased stock and scrap recycling problems. Hence a single alloy, suitable for both the inner and outer panels is a very desirable feature.

In addition, since formed automotive body panels are customarily painted and then subjected to a paint-baking treatment typically at a temperature of 177°–204° C., the sheet alloy used for such panels should not be adversely affected by this thermal treatment. Preferably, the alloy should exhibit an age-hardening response to the paint-bake treatment, i.e. it should increase in strength when subjected thereto.

Aluminum alloys previously proposed for use in automotive body members have included the alloys bearing the Aluminum Association designations AA 2036 and AA X2038. A disadvantage of the 2036 alloy is that it does not age harden during typical paint-bake cycles, but on the contrary may even undergo reduction in strength during paint-baking. AA X2038 alloy does exhibit appreciable age hardening at the usual paint-bake temperatures, but both of these alloys, which are high-copper alloys, have relatively low corrosion resistance.

It has also been proposed, for example in U.S. Pat. No. 4,082,578, to use Al-Mg-Si alloys for making automotive body panels. The patent refers to alloys having a content (in percent by weight) of 0.4–1.2% Si, 0.4–1.1% Mg, 0.2–0.8% Mn, 0.05–0.35% Fe, and 0.1–0.6% Cu, balance aluminum and incidental elements and impurities. Two examples of specific alloys of this type are those identified by the Aluminum Association's designations AA 6009 and AA 6010. Current published composition ranges and limits for the aforementioned alloys, and for two other known alloys of the Al-Mg-Si type (AA 6011 and AA 6110), used respectively for venetian blind slats and for wire and nails, are set forth in Table I.

TABLE I

| | Range or Maximum (Percent by Weight)[1] | | | | | |
|---|---|---|---|---|---|---|
| | AA 2036 | AA X2038[2] | AA 6009 | AA 6010 | AA 6011[3] | AA 6110 |
| Cu | 2.2–3.0 | 0.8–1.8 | 0.15–0.6 | 0.15–0.6 | 0.40–0.9 | 0.20–0.7 |
| Mg | 0.30–0.6 | 0.40–1.0 | 0.40–0.8 | 0.6–1.0 | 0.6–1.2 | 0.50–1.1 |
| Si | 0.50 | 0.50–1.3 | 0.6–1.0 | 0.8–1.2 | 0.6–1.2 | 0.7–1.5 |
| Fe | 0.50 | 0.6 | 0.50 | 0.50 | 1.0 | 0.8 |
| Mn | 0.10–0.40 | 0.10–0.40 | 0.20–0.8 | 0.20–0.8 | 0.8 | 0.20–0.7 |
| Ti | 0.15 | 0.15 | 0.10 | 0.10 | 0.20 | 0.15 |
| Cr | 0.10 | 0.20 | 0.10 | 0.10 | 0.30 | 0.04–0.25 |
| Zn | 0.25 | 0.50 | 0.25 | 0.25 | 1.5 | 0.30 |

[1]In each of the specified alloys, the maximum content of other elements is 0.05% each, 0.15% total; and the remainder of the alloy is aluminum.
[2]Ga, up to 0.05% max; V, up to 0.05% max.
[3]Ni, up to 0.20% max.

Alloys AA 6009 and AA 6010 both undergo age-hardening during paint baking and have substantially higher resistance to corrosion than alloys AA 2036 and AA X2038. AA 6009, which has a nominal content of 0.50% Mg and 0.80% Si, exhibits lower strength but higher formability than AA 6010, which has a nominal content of 0.80% Mg and 1.00% Si. Especially for automotive body use, it would be desirable to provide an aluminum alloy sheet having higher strength than AA 6009 and greater formability than AA 6010.

SUMMARY OF THE INVENTION

The present invention broadly contemplates the provision of aluminum alloy sheet constituted of an alloy consisting essentially of 0.65–0.79% Cu, 0.62–0.82% Mg, 0.60–1.0% (most preferably 0.70–0.90%) Si, 0.10–0.50% Mn, up to 0.40% Fe, up to 0.10% Ti, balance Al. Minor amounts of other elements may be present insofar as they do not materially affect the combination of properties attained by the present invention. Preferably, the Mn content is 0.17–0.27%, the upper limit of Fe content is 0.30%, and the upper limit of Ti content is 0.03%. All proportions here and elsewhere herein are expressed as percentages by weight. The term "sheet," as herein broadly used, is intended to embrace gauges sometimes referred to as "plate" and "foil" as well as sheet gauges intermediate plate and foil.

Sheet of this alloy, produced by casting an ingot of the alloy, homogenizing the ingot, hot rolling the ingot to produce a slab, cold rolling the slab to produce the sheet, and solution-heat-treating the sheet, has properties of strength and formability suitable for forming into automotive body members and is age hardenable under paint-baking conditions. Accordingly, the invention further contemplates the provision of an automotive body member comprising a formed and age-hardened article of the above-described sheet and also contemplates the provision of a method of producing the sheet, including the aforementioned steps.

It is found that alloy sheet in accordance with the invention has a superior combination of strength and formability, as desired for automobile body use. Specifically, the alloy sheet of the invention has higher strength than AA 6009 alloy; better formability (though slightly lower strength) than AA 2036, AA X2038, and AA 6010 in the T4 temper; bendability sufficient to enable hem flanging operation; superior work hardening behavior (as compared to AA 6010 and AA X2038) at relatively low strains; an excellent age-hardening response to paint-bake treatments, i.e. a high yield strength after paint bake, affording good resistance to denting, unlike AA 2036; and corrosion resistance superior to that of AA 2036 and AA X2038 and comparable to that of AA 6009 and AA 6010. Also, required minimum temperatures for solution heat treatment are lower, and the solution heat treatment temperature range is correspondingly wider and less critical, than in the case of alloys such as AA 6010. It is at present believed that this combination of properties is attributable, inter alia, to the lower Mg and Si content of the alloy as compared with AA 6010, and the higher copper content as compared with AA 6009 and 6010, as well as the control of Fe and Mn content. Reduction in Mg and Si is believed to enhance formability but to decrease strength, while the addition of copper is believed to provide a compensating increase in strength without impairing formability; indeed, the added copper may even contribute to improved formability in this alloy.

Further features and advantages of the invention will be apparent from the detailed description hereinbelow set forth, together with the accompanying drawings.

DETAILED DESCRIPTION

Figure 1:
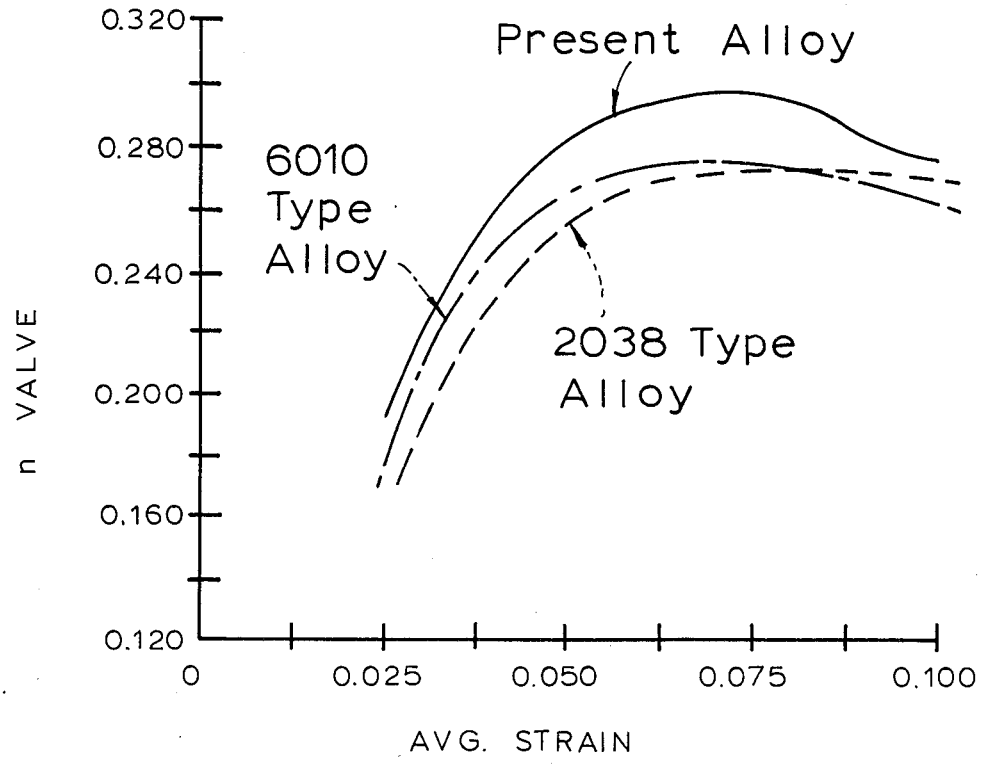
FIG. 1 is a graph representing work hardening exponent n as a function of average strain, for sheet of various alloys including alloy sheet embodying the present invention.

The invention will be described as embodied in aluminum alloy sheet suitable for forming into automotive body members (e.g. body members for cars, trucks, or other automotive vehicles), in a method of producing such sheet, and in automotive body members formed therefrom, wherein the alloy is a heat-treatable alloy of the following composition:

| | Range or Maximum (%) | Nominal |
|---|---|---|
| Cu | 0.65–0.79 | 0.75 |
| Mg | 0.62–0.82 | 0.72 |
| Si | 0.60–1.0(1) | 0.80 |
| Mn | 0.10–0.50(2) | 0.20 |
| Fe | 0.40(3) | 0.20 |
| Ti | 0.10 | |
| Al | balance(4) | |

(1)most preferably 0.70–0.90%
(2)preferably 0.17–0.27%; most preferably 0.20–0.25%
(3)preferably up to 0.30%
(4)other elements may be present in amounts not materially affecting the combination of properties achieved by the invention. For instance, other elements may be present in amounts preferably up to 0.05% each, up to 0.15% total (most preferably up to 0.03% each, up to 0.10% total), although in some instances larger amounts of particular elements may be tolerated.

In this alloy, the magnesium and silicon combine as $Mg_2Si$, imparting a considerable strength improvement after age-hardening. Some excess silicon, above the stoichiometric ratio of $Mg_2Si$ and for the formation of Al(FeMn)Si constituents, is required to aid in accelerating artificial ageing. The content of Mg and Si is limited, because excess Si is detrimental to formability in general, especially with respect to minimum crack-free bending radius R (usually expressed in terms of the ratio R/t, where t is the sheet thickness). The excess Si is preferably kept to below 0.4% and is calculated by subtracting from the total Si content the Si needed for $Mg_2Si$ (Mg/1.73) and the Fe-containing phase (Fe/3).

The copper content of the present alloy contributes to yield strength and especially to rapidity of age-hardening response, e.g. when the sheet is subjected to a paint-baking treatment, yet with significantly less adverse effect on bendability than excess silicon. Thus, the relatively high Cu content and the relatively low Mg and Si content cooperatively provide an advantageous combination of strength, age-hardening properties and formability. Indeed, it is at present believed that the Cu content of the described alloy may enhance formability, since applicant has found that as Cu is increased in an alloy of this type the ultimate tensile strength increases more rapidly than the yield strength (of the sheet in T4 temper), and such increasing differential between ultimate tensile strength and yield strength is usually an indication of improved formability. At the same time, the Cu content is low enough so that the alloy has desirably high resistance to corrosion.

Iron content is found to have a significant effect on minimum crack-free bending radius. For most practical purposes, Fe is not soluble in solid aluminum but is present as second phase constituents, e.g. $FeAl_3$ or an Al(FeMn)Si phase, frequently located at grain boundaries. Upon bending, cracking initiates at constituent interfaces and propagates. It is therefore believed that low Fe content and fine distribution of the iron-bearing phases improves bending characteristics.

Manganese is believed to contribute to strength, and assists in controlling grain size and the toughness of the heat-treated sheet. Excesssive amounts of Mn, however, increase the size of the Fe-containing particles with which Mn is associated, adversely affecting bendability. Mn additionally combines with Fe and Si to form fine dispersoids of cubic alpha-Al(Mn,Fe)Si type which contribute slightly to the strength of the alloy but also serve to nucleate coarser (and, therefore, less effective) precipitate during age-hardening treatment. Thus the present alloy contains Mn but at a low level, optimally 0.20–0.25%.

To produce sheet, the above-described alloy is cast into ingots, for example by the procedure known as direct chill casting (although other casting operations such as twin-belt continuous casting of strip ingot may alternatively be employed), and e.g. under conditions generally conventional for casting sheet ingot of Al-Mg-Si alloys. After scalping, the ingot is fully homogenized, by heating to a temperature and for a period sufficient to achieve essentially complete dissolution of soluble phases, so that the only second phase particles remaining are the insoluble Fe- and Mn-containing intermetallic constituents. Conditions effective to achieve such full homogenization will be readily apparent to those skilled in the art. Under-homogenization is to be avoided, because large particles of undissolved $Mg_2Si$ not only deprive the alloy of solute elements which should contribute to age-hardening but also provide long interfaces with the Al matrix where cracking can initiate. The relatively low $Mg_2Si$ content of the present alloy facilitates complete dissolution of soluble phases.

The homogenized ingot is then hot-rolled to a suitable slab gauge, with care taken to avoid long holding times in the critical temperature range, such as could enable precipitation of coarse $Mg_2Si$ particles (which would be difficult to dissolve during subsequent solution heat treatment); and the slab is cold-rolled to the desired final sheet gauge, viz. a gauge suitable for forming automobile body panels. An exemplary finish hot-roll (slab) gauge is 0.200 inch, and an illustrative final cold-rolled sheet gauge is 0.040 inch. In some instances, the hot-roll finish gauge may be an acceptable final gauge, and the hot-rolled material can be heat-treated (i.e. without any cold rolling) to give satisfactory final properties.

Thereafter, the cold-rolled sheet is subjected to a solution heat treatment, for example by heating to a temperature of 535° C. or higher (e.g. 560° C.) for about half a minute or more in a continuous solution-heat-treating line, followed by a rapid (water) quench. Since the quench sensitivity of the present alloy is less than that of 6010 and 2038 alloys, it may alternatively be air-quenched. The solution heat treatment time and temperature are controlled to dissolve all, or nearly all, the soluble elements and the quenching rate is selected to be high enough to retain these elements in a supersaturated state in order to obtain maximum age hardening in the finished part. It is found that satisfactory solution heat treatment can be achieved, with the present alloy, at temperatures lower than those required for AA 6010. A levelling operation is normally carried out after heat treatment.

FIG. 1 depicts the work hardening exponent "n" to an increment of strain, for sheet of various aluminum heat treatable alloys (including sheet of the alloy of the present invention, termed "present alloy" in the drawing, and sheet of alloy types 6010 and X2038) used or usable in the manufacture of autobody sheet components. These data have been obtained by fitting the so-called Ludwik equation to the tensile results. This equation is a mathematical fit of the true stress-true strain data of a plastically deforming material; generally tested in tension, as in tensile testing. The Ludwik equation is given by $$\sigma=\sigma_o+k\epsilon^n$$

where $\sigma$=true stress $\sigma_o$=onset of plastic deformation ($\simeq$ yield strength)

k=pre-exponential constant $\epsilon$=true strain n=work or strain hardening exponent.

Since the true stress for most metallic materials monotonically increases with strain, the exponential term has been called the work or strain hardening exponent. This work hardening exponent is a common indicator of the material's ability to increase in strength with increasing strain, and is usually obtained as an average over the strains where the material is deforming plastically.

The significance of FIG. 1 is that in most modern stretch forming operations, the resulting components are produced by uniformly stretching the material, such that no one region experiences a large amount of strain. Hence the material's ability to distribute the imposed strain uniformly at low strains takes on added importance. A high work hardening exponent is beneficial to a material's ability to uniformly distribute the imposed strain.

As previously mentioned, the work hardening exponent, which is frequently used as a formability parameter, is an average over the entire plastic region (true strains up to 0.25). FIG. 1 depicts the evaluation of the material's work hardening ability with strain, particularly at low strains.

Thus, FIG. 1 graphically compares the effect of strain on work hardening behavior, in sheet of the present alloy and of alloy types 6010 and X2038, at the relatively low strains involved in stretch-draw forming. This plot of work hardening exponent n against average strain was obtained using a least squares fit to the Ludwik constitutive equation over a given strain interval (approximately 0.04 strain); hence the average strain value represents the strain averaged over the increment chosen. The present alloy exhibits a superior work-hardening behavior which is maintained up to approximately 0.10 strain. It is also to be noted that the work hardening exponent for the present alloy, when fitted to the entire plastic deformation region, maintains its superiority.

The combination, in the present alloy, of a slightly lower yield strength and high work hardening capability likely minimizes the amount of springback, and hence allows for a reduced draw-die overcrown and better overall shape control, in stretch-draw forming. An additional advantage of this high work hardening material which contains a fine distribution of constituent particles is improved bending performance.

Typically after natural aging (e.g. for one week at room temperature) to T4 temper, the produced sheet can be formed into an automobile body panel such as a door, hood, or other automotive body member, for example by a generally conventional stretch-draw procedure as referred to above. The formed article is painted, and subjected to paint-baking treatment, e.g. by heating (in a paint-baking line) for about one hour at a temperature of about 177° to 204° C. The member thus formed from sheet of the present alloy undergoes substantial age hardening during this paint-baking treatment.

Figure 2:
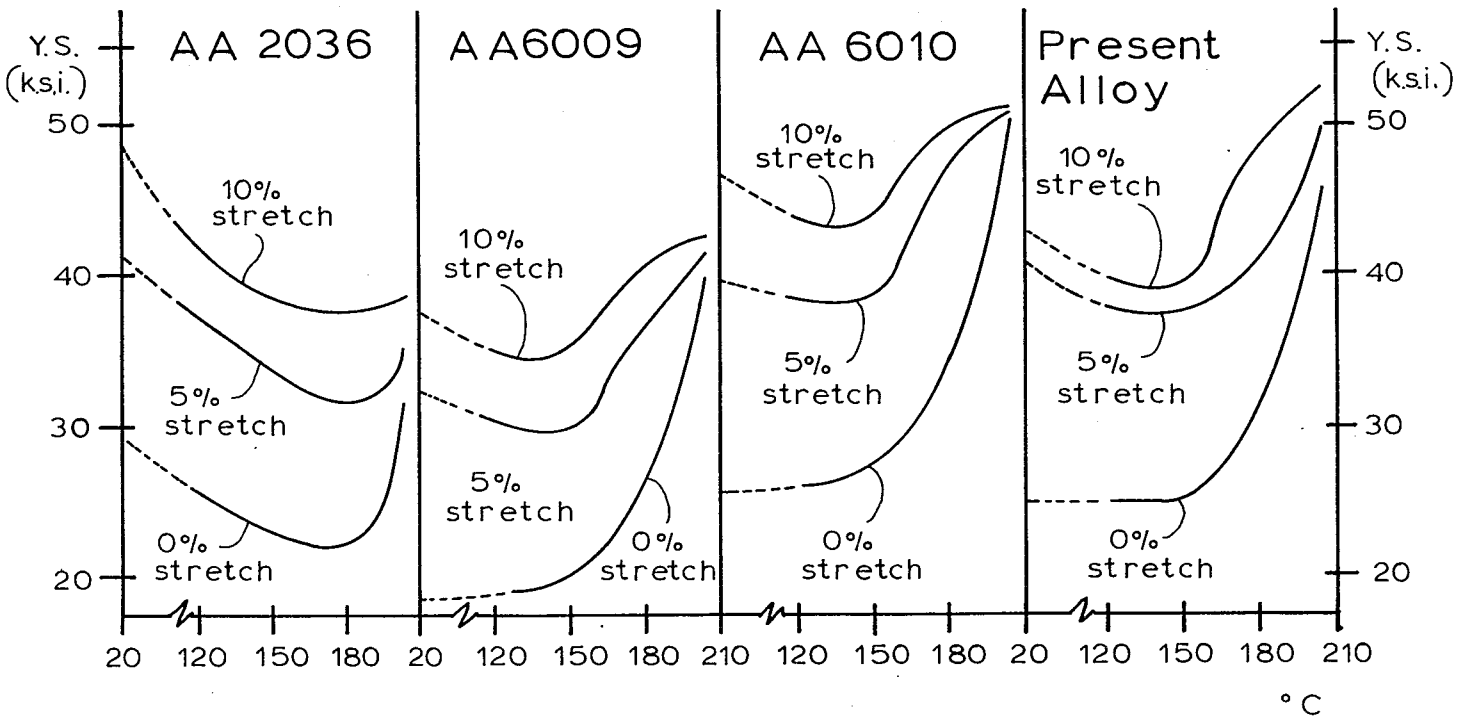
FIG. 2 is a graph representing yield strength in thousands of pounds per square inch (k.s.i.) as a function of paint-baking temperature (°C.) for sheet of various alloys, including alloy sheet embodying the present invention, which have received various amounts of stretch before being subjected to one-hour paint-baking treatment at the indicated temperature.

FIG. 2 graphically compares the age-hardening response (effect on yield strength), under paint-baking conditions, of sheet of the present alloy with sheet of alloys AA 2036, AA 6009, and AA 6010, showing that the present alloy age-hardens only slightly less than AA 6010 and substantially more than the other two alloys. The paint-bake treatments, one hour at 150°, 177°, and 204° C., were carried out after one week of natural aging (following solution heat treatment and deformation of either 0, 5, or 10% obtained by stretching) and the 0.2% yield strengths were measured one week after paint baking. In most cases, the strength was obtained for samples taken perpendicularly to the rolling direction. All strengths are expressed in thousands of pounds per square inch (k.s.i.).

By way of further illustration of the invention, reference may be made to the following specific examples:

EXAMPLE I

As an example of aluminum alloy sheet according to the present invention, an alloy containing 0.71% Cu
0.20% Fe
0.75% Mg
0.19% Mn
0.93% Si
0.012% Ti was cast in 18"×72" DC sheet ingot, scalped, homogenized 10 hours at 540° C., cooled to 525° C. and hot rolled to 0.18" slab which was later cold rolled to 0.038" sheet. The sheet was solution heat treated in a continuous furnace where the metal temperature reached 560° C. and then water quenched. The total time the metal was in the heating zone was just under half a minute.

The T4 properties measured after 7 or 8 weeks of natural aging were as follows:

| | |
|---|---|
| Ultimate tensile strength (U.T.S.): | 44–45 k.s.i. |
| 0.2% yield strength (0.2% Y.S.): | 22–23 k.s.i. |
| elongation (Elong.): | 27–29% |
| work hardening coefficient ("n"): | 0.26–0.28 |
| Min. R/t: | 0.35–0.43 (in longitudinal direction) 0.46–0.62 (in transverse direction) |

"Min. R/t" is the bending radius/sheet thickness ratio for the minimum radius at which crack-free bending could be performed.

EXAMPLE II

As a further example of metal within the composition limits of the invention, an alloy containing 0.77% Cu
0.27% Fe
0.72% Mg
0.28% Mn
0.86% Si
0.02% Ti
0.01% Zn was cast in 18"×80" DC sheet ingot, scalped, homogenized 6 hours at 550° C., cooled to 525° C. and hot rolled to 0.18" slab. After cold rolling to 0.037" sheet the material was solution heat treated in a continuous furnace and reached a temperature of 560° C. and, then, water quenched.

The T4 properties measured after 3 or 4 weeks of natural aging were as shown in Table II which also includes values given in the literature for alloys 6010 and 2038.

TABLE II

| Property | Comparison of Typical Values: Present Alloy | 2038[1] | 6010[2] |
|---|---|---|---|
| U.T.S. (ksi) | 42 | 47 | 42 |
| 0.2% Y.S. (ksi) | 23 | 28 | 25 |
| Elong. (%) | 26–29 | 25 | 24 |
| Min. R/t | 0.3–0.5 | 0.30–0.60 | 0.50–1.0 |
| "n" | 0.27 | 0.26 | 0.22 |
| Erichsen Cup (in.) | 0.33 | — | — |
| Limiting Dome Height (in.) | 1.5 | — | — |

[1]Reynolds Aluminum - Bulletin No. 263, 28 May 1981
[2]Data on Aluminum Alloy Properties and Characteristics for Automotive Applications, Aluminum Association Bulletin T9.

It is at present believed that in the alloy sheet of the invention, three kinds of precipitates form during age hardening: $CuMgAl_2$, $Mg_2Si$, and $CuAl_2$. Of these, $CuMgAl_2$ is believed to have the greatest strengthening influence.

The foregoing results demonstrate the superiority of the present alloy to AA 6010 in formability (e.g. as represented by percent elongation) and to AA 6009 in yield strength. The present alloy is superior to both 6010 and X2038 in bendability and promotion of uniform deformation during stretch-draw forming, though slightly weaker than these latter alloys.

Corrosion resistance was tested by (1) exposing samples in a neutral salt spray (ASTM B117) for six weeks or immersing them for three months in water of the Kingston, Ontario, municipal supply from Lake Ontario (content: 25 p.p.m. $SO_4$, 19 p.p.m. Cl, 117 p.p.m. $NaHCO_3$; total hardness 135 p.p.m., pH 7.8). Weight losses and depth of the deepest pits were determined. Comparative results for sheet of the present alloy and other alloys are given in Table III:

TABLE III

| Alloy (AA) | Neutral Salt Spray: Weight Loss g/m² (1 side) | Max. Pit Depth (microns) | Immersion in Kingston Tap Water-Max. Pit Depth (microns) |
|---|---|---|---|
| 2036 | 22.4 | 650 | 760 |
| X2038 | 11.9 | 480 | 560 |
| Present alloy | 11.2 | 240 | 410 |
| 6010 | 10.3 | 220 | 380 |

TABLE III-continued

| Alloy (AA) | Neutral Salt Spray Weight Loss g/m$^2$ (1 side) | Neutral Salt Spray Max. Pit Depth (microns) | Immersion in Kingston Tap Water-Max. Pit Depth (microns) |
|---|---|---|---|
| 6009 | 9.5 | 210 | 330 |

These results demonstrate that the present alloy affords corrosion resistance markedly superior to that of AA 2036 and AA X2038.

It is to be understood that the invention is not limited to the features and embodiments hereinabove set forth but may be carried out in other ways without departure from its spirit.

We claim:

1. Aluminum alloy sheet constituted of an alloy consisting essentially of 0.65–0.79% Cu, 0.62–0.82% Mg, 0.60–1.0% Si, 0.10–0.50% Mn, up to 0.40% Fe, up to 0.10% Ti, balance Al.

2. Sheet as defined in claim 1, wherein the Mn content is 0.17–0.27%.

3. Sheet as defined in claim 1, wherein the Fe content is up to 0.30%.

4. Sheet as defined in claim 3, wherein the Mn content is 0.17–0.27%.

5. Sheet as defined in claim 1, wherein the Si content is 0.70–0.90%.

6. Sheet as defined in claim 1, produced by casting an ingot of the alloy, homogenizing the ingot, hot rolling the ingot to produce a slab, cold rolling the slab to produce the sheet, and solution-heat-treating the sheet.

7. Aluminum alloy sheet having strength and formability suitable for forming into automotive body members and age-hardenable under paint-baking conditions, said sheet being constituted of an alloy consisting essentially of 0.65–0.79% Cu, 0.62–0.82% Mg, 0.70–0.90% Si, 0.17–0.27% Mn, up to 0.30% Fe, up to 0.03% Ti, balance Al, said sheet being produced by casting an ingot of the alloy, homogenizing the ingot, hot rolling the ingot to produce a slab, cold rolling the slab to produce the sheet, and solution-heat-treating the sheet.

8. An automotive body member comprising a formed and age-hardened article of sheet of an aluminum alloy consisting esssentially of 0.65–0.79% Cu, 0.62–0.82% Mg, 0.70–0.90% Si, 0.17–0.27% Mn, up to 0.30% Fe, up to 0.03% Ti, balance Al, said sheet being produced by casting an ingot of the alloy, homogenizing the ingot, hot rolling the ingot to produce a slab, cold rolling the slab to produce the sheet, and solution-heat-treating the sheet.

* * * * *